US007273396B2

(12) United States Patent
Itano et al.

(10) Patent No.: US 7,273,396 B2
(45) Date of Patent: Sep. 25, 2007

(54) CONNECTOR ISOLATION SHIELDING SYSTEM AND METHOD

(75) Inventors: Michael Itano, Sammamish, WA (US); Frank Chin-Hwan Kim, Woodinville, WA (US); John Redfield, Brier, WA (US); Jeffrey P. Seefried, Lake Stevens, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 11/424,219

(22) Filed: Jun. 14, 2006

(65) Prior Publication Data

US 2007/0026736 A1 Feb. 1, 2007

Related U.S. Application Data

(60) Provisional application No. 60/690,821, filed on Jun. 14, 2005.

(51) Int. Cl.
*H01R 13/648* (2006.01)

(52) U.S. Cl. ..... 439/607; 439/404

(58) Field of Classification Search ..... 439/607, 439/676, 404, 405, 610, 941
See application file for complete search history.

(56) References Cited

U.S. PATENT DOCUMENTS 5,207,597 A * 5/1993 Kline et al. ..... 439/607
5,378,172 A * 1/1995 Roberts ..... 439/607
6,126,476 A * 10/2000 Viklund et al. ..... 439/404

* cited by examiner

*Primary Examiner*—Javaid H. Nasri
(74) *Attorney, Agent, or Firm*—Brian L. Johnson; George C. Rondeau, Jr.; Davis Wright Tremaine LLP

(57) ABSTRACT

Implementations of a shielded connector system involve connector isolation shielding using shield enclosures to reduce crosstalk and noise transmitted between adjacent signal cable connectors. These implementations allow for manufacture of new equipment and also retrofitting of existing equipment for connector isolation shielding using standard connector configurations without specialized labor intensive terminations for cable and for connectors required of conventional approaches.

5 Claims, 12 Drawing Sheets

CONNECTOR ISOLATION SHIELDING SYSTEM AND METHOD

CROSS REFERENCE TO RELATED APPLICATION

This application claims priority benefit of provisional application Ser. No. 60/690,821 filed Jun. 14, 2005, the content of which is incorporated in its entirety.

BACKGROUND OF THE INVENTION

1. Field of the Invention

The present invention is generally related to communication stations and associated signal cable connectors.

2. Description of the Related Art

With increases in data rates, such as including data rates of 10 gigabits over copper base cable, isolation of external cross-talk and noise between adjacent signal cable connectors (jacks), in addition to the customary isolation of internal cross-talk and noise between signal pairs within a connector, has become a focus of concern. When internal crosstalk and noise within individual connectors and external crosstalk and noise transmitted between connectors are reduced, signal quality can be enhanced and data rates can be increased. With the advent of new cable designs that isolate external crosstalk and noise between cabling systems, it has become even more desirable to reduce external crosstalk and noise between connectors as well.

Conventional approaches to reduce external crosstalk and noise between connectors have used shielded connectors such as for specialized secure communication. Unfortunately, conventional shielded connectors require terminations for cable and for connectors that are labor intensive to implement.

BRIEF DESCRIPTION OF THE SEVERAL VIEWS OF THE DRAWING(S)

DETAILED DESCRIPTION OF THE INVENTION

As discussed herein implementations of a shielded connector system involve connector isolation shielding using shield enclosures to reduce crosstalk and noise transmitted between adjacent signal cable connectors. These implementations allow for manufacture of new equipment and also retrofitting of existing equipment for connector isolation shielding using standard configurations of connectors without specialized labor intensive terminations for the cable and for the connectors is required of conventional approaches.

Shield enclosure implementations may be fabricated to include either a sheet metal part, a cast part, or an injection molded part. Some shield enclosure implementations only have one of its walls providing a majority of shielding for a pair of connectors positioned on either side of the wall at times when casting or injection molding is used to form the shield enclosure implementation. On the other hand, shield enclosure implementations as stamped parts can have walls as little as 0.008 inches thick allowing for more than one wall to provide shielding. Regarding injection molded implementations, shielding can be enhanced by a foil shield that is placed on the side of a connector that is not covered by the injection molded shield enclosure.

Figure 1:
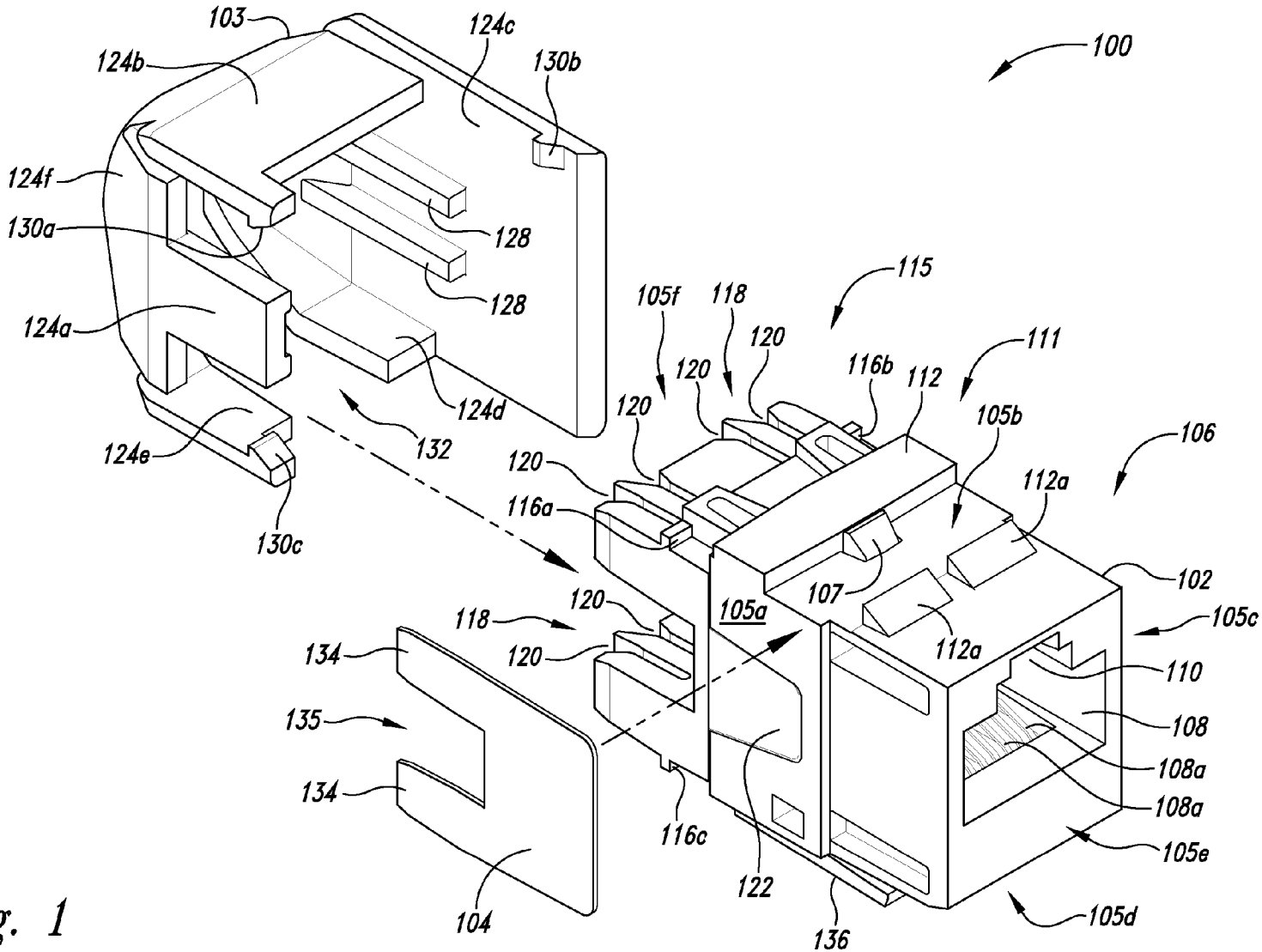
FIG. 1 is an exploded front perspective view of a first implementation of a shielded connector system.

A first implementation 100 of the shielded connector system is shown in FIG. 1 as having a connector 102, a shield enclosure 103, and a shield sheet 104. Implementations of the shield enclosure 103 can be cast or injection molded. The shield enclosure 103 can have a matrix of ABS plastic with 10% stainless steel fibers to shield noise and crosstalk. As shown, the shield enclosure 103 is shaped to cover portions of the connector 102. The shield sheet 104 can be laminated with a signal deterring material such as an electrically conductive material like aluminum foil. The shield sheet can be glued, otherwise adhered, or otherwise affixed to the connector 102. As further shown, the relative thinness of the shield sheet 104 allows the shield enclosure 103 to be relatively thick with its material, such as the ABS-stainless steel composite, being fully used on one side of the connector 102. In some implementations the relative greater thickness of the shield enclosure 103 may also more readily allow for manufacture of the shield enclosure.

Figure 5:
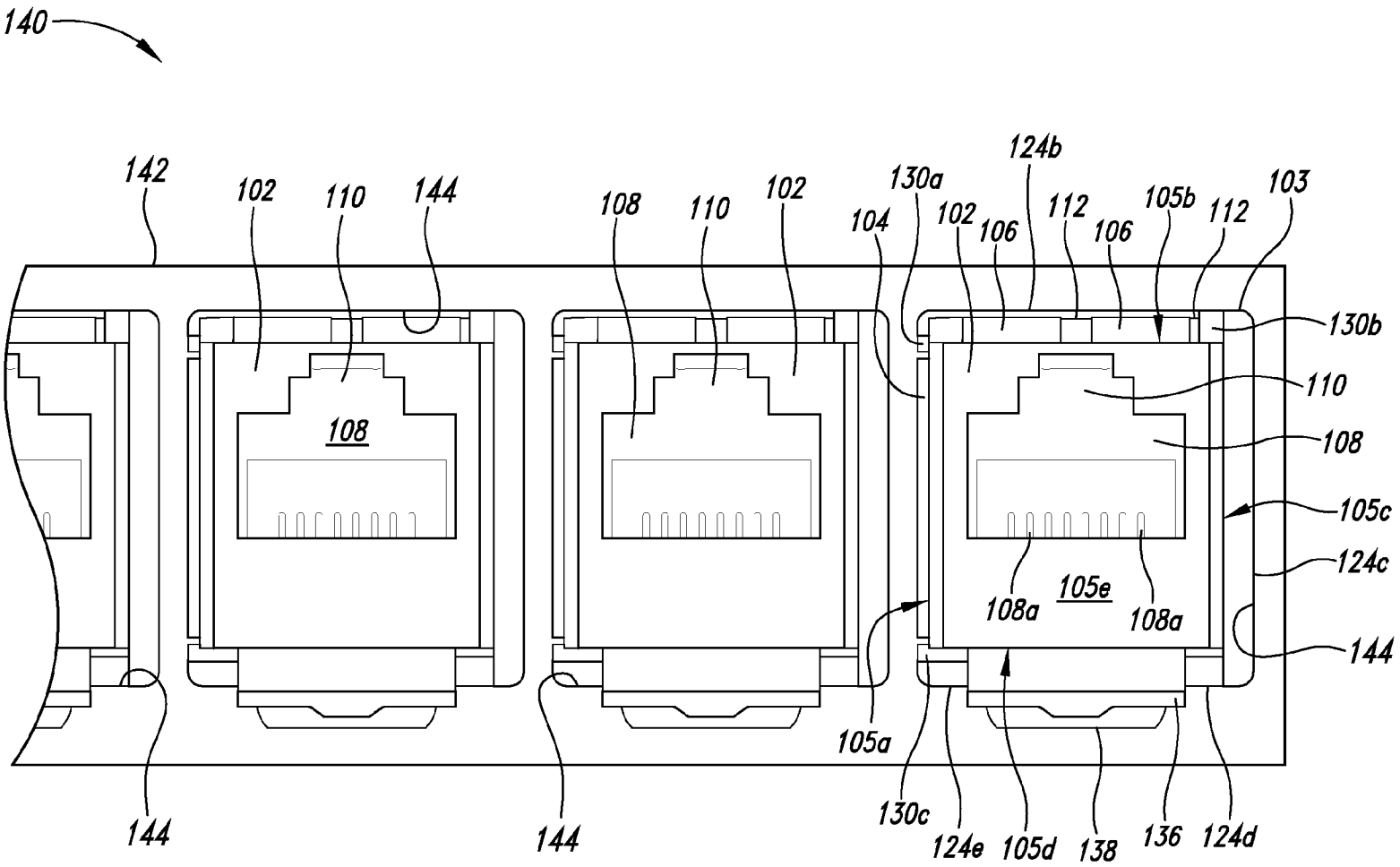
FIG. 5 is a front elevational view of a communication station containing the shielded connector system of FIG. 1.
Figure 6:
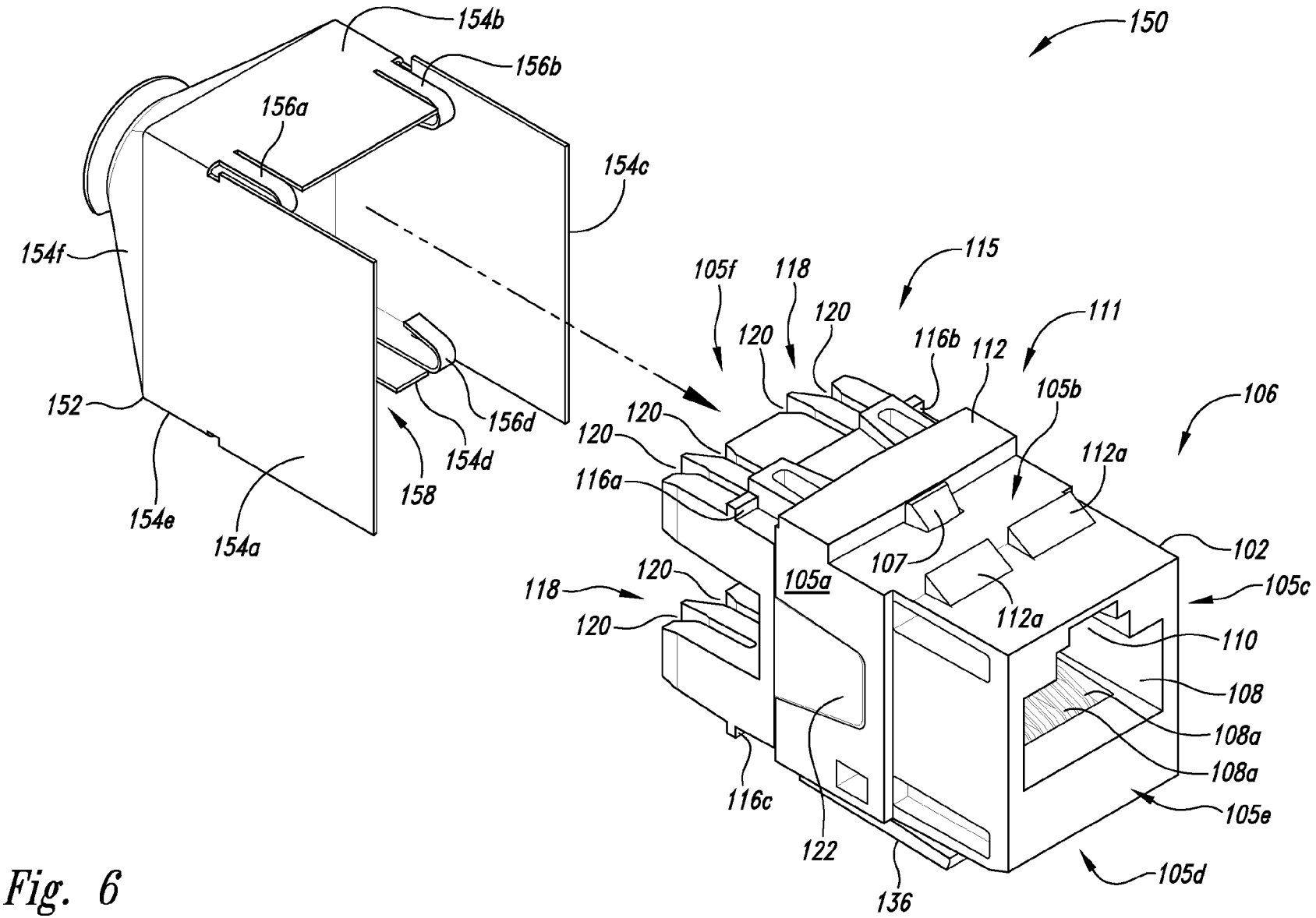
FIG. 6 is an exploded front perspective view of a second implementation of a shielded connector system.

The connector 102 includes a first face 105*a*, a second face 105*b*, a third face 105*c*, a fourth face 105*d*, a front face 105*e*, and a rear face 105*f*. The connector 102 has a front section 106 with beveled tabs 106*a* extending therefrom on the second face 105*b* to assist in part for engagement with a connector port of a stand-alone or rack mounted station (see examples below regarding FIG. 5 and FIG. 10). The front section 106 has a plug receiving portion 108 with contacts 108*a* positioned to couple with contacts of a conventional communication plug (not shown) generally coupled to a conventional signal cable (not shown) received through the front face 105*e*. The plug receiving portion 108 has a plug engagement notch 110 for engagement with the conventional communication plug (not shown). As shown, the plug engagement notch 110 is adjacent the second face 105*b*. A mid-section 111 extends rearward from the front section 106 toward the rear face 105*f* of the connector 102. The mid-section 111 includes a spacer 112 and a beveled tab 112*a* that extend from the second face 105*b* of the connector 102. A rear section 115 extends rearward from the mid-section 111 to include the rear face 105*f*. The rear section 115 includes a first tab 116*a* and a second tab 116*b* that extend from the second face 105*b* of the connector 102. A third tab 116*c* and a fourth tab 116*d* extend from the fourth face 105*d* on the connector 102. Wire receivers 118 (such as insulation displacement contacts—IDCs) are positioned along the rear face 105*f*, each with a correspondingly positioned wire slot 120 to receive a wire (not shown) for electrical connection of the wires to the wire receivers, which are electrically connected to contacts 108*a* of the plug receiving portion 108. A notch portion 122 is located along the first face 105*a* of the connector 102.

The shield enclosure 103 includes a first wall 124*a*, a second wall 124*b*, a third wall 124*c*, a first portion of a fourth wall 124*d*, a second portion of the fourth wall 124*e*, and a rear wall 124*f*. The shield enclosure 103 has engagement portions including a first beveled tab 130*a*, a second beveled tab 130*b*, and a third beveled tab 130*c*. The engagement portions allow the shield enclosure 103 to be coupled with the connector 102 by a snap fit engagement. The first beveled tab 130*a* extends from the second wall 124*b*. The second beveled tab 130*b* extends from the third wall 124*c*. The third beveled tab 130*c* extends from the second portion of the fourth wall 124*e*. When the shield enclosure 103 engages with the connector 102, the first beveled tab 130*a* of the shield enclosure engages with the first tab 116*a* of the connector 102, the second beveled tab 130*b* of the shield enclosure engages with a forward face of the spacer 112 of the connector, and the third beveled tab 130*c* engages with the third tab 116*c*. Other implementations use other types of engagement portions of snap fit engagement or other removably engagement of the shield enclosure 103 with the connector 102. The first portion of the fourth wall 124*d* and the second portion of the fourth wall 124*e* are spaced apart to form a slot 132 used in part for access to wire that is coupled with the wire pair receivers 118. In some implementations the slot 132 may allow the shield enclosure 103 to be snapped onto the connector 102 while wires (not shown) are coupled to the wire receivers 118. Spacers 128 extend from the third wall 124*c* to assist in positioning of the shield enclosure 103 when engaged with the connector 102.

Figure 2:
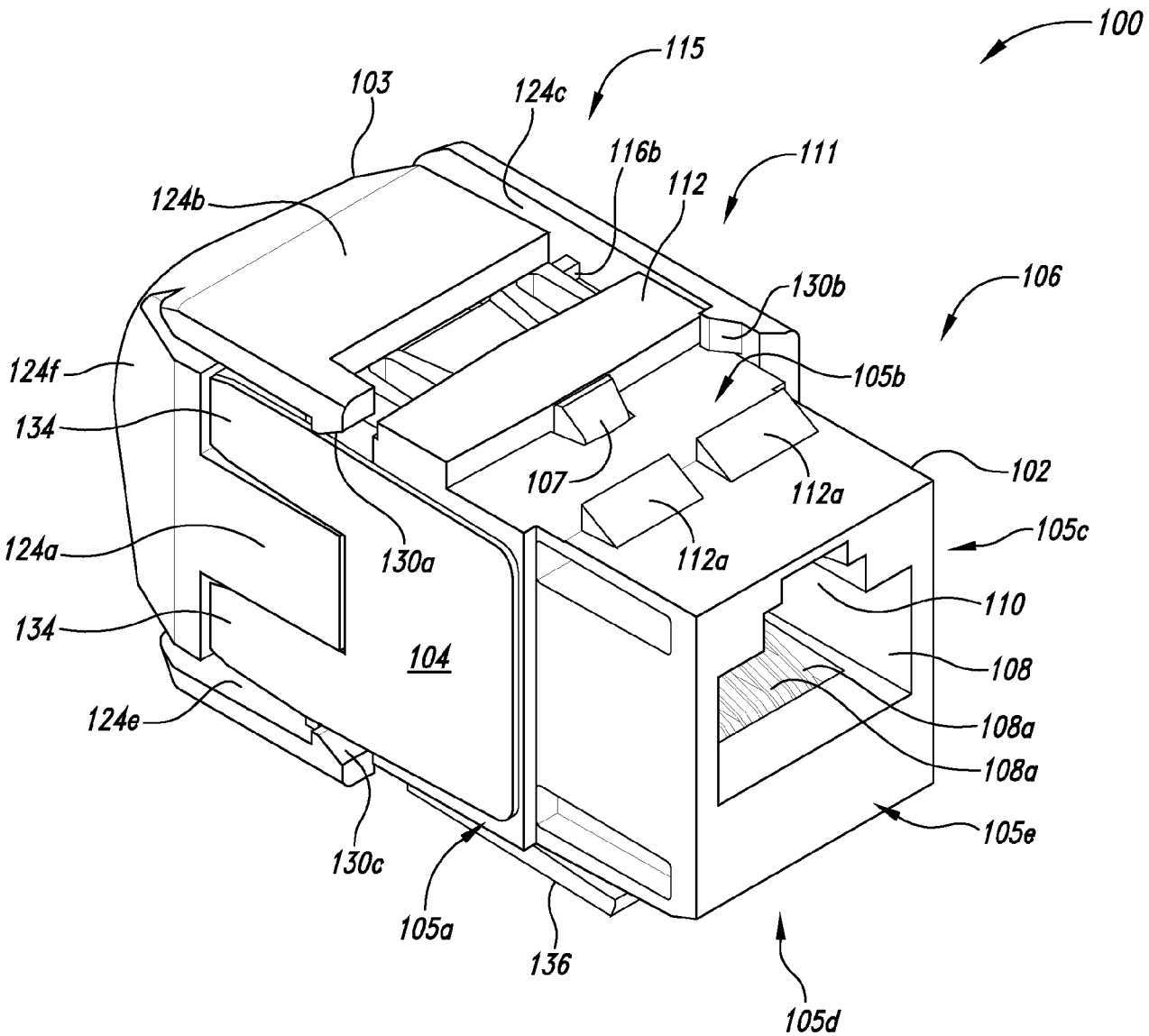
FIG. 2 is a front perspective view of the first implementation of the shielded connector system of FIG. 1.

The shield sheet 104 includes two rearwardly extended portions 134 spaced apart to form a slot 135 therebetween. As shown in FIG. 2, the slot 135 is sized to receive the first wall 124*a* to allow for substantially continuation coverage along the first face 105*a* of the mid-section 111 and the rear section 115 when shield enclosure 103 and the shield sheet 114 are engaged and/or affixed to the connector 102.

Figure 3:
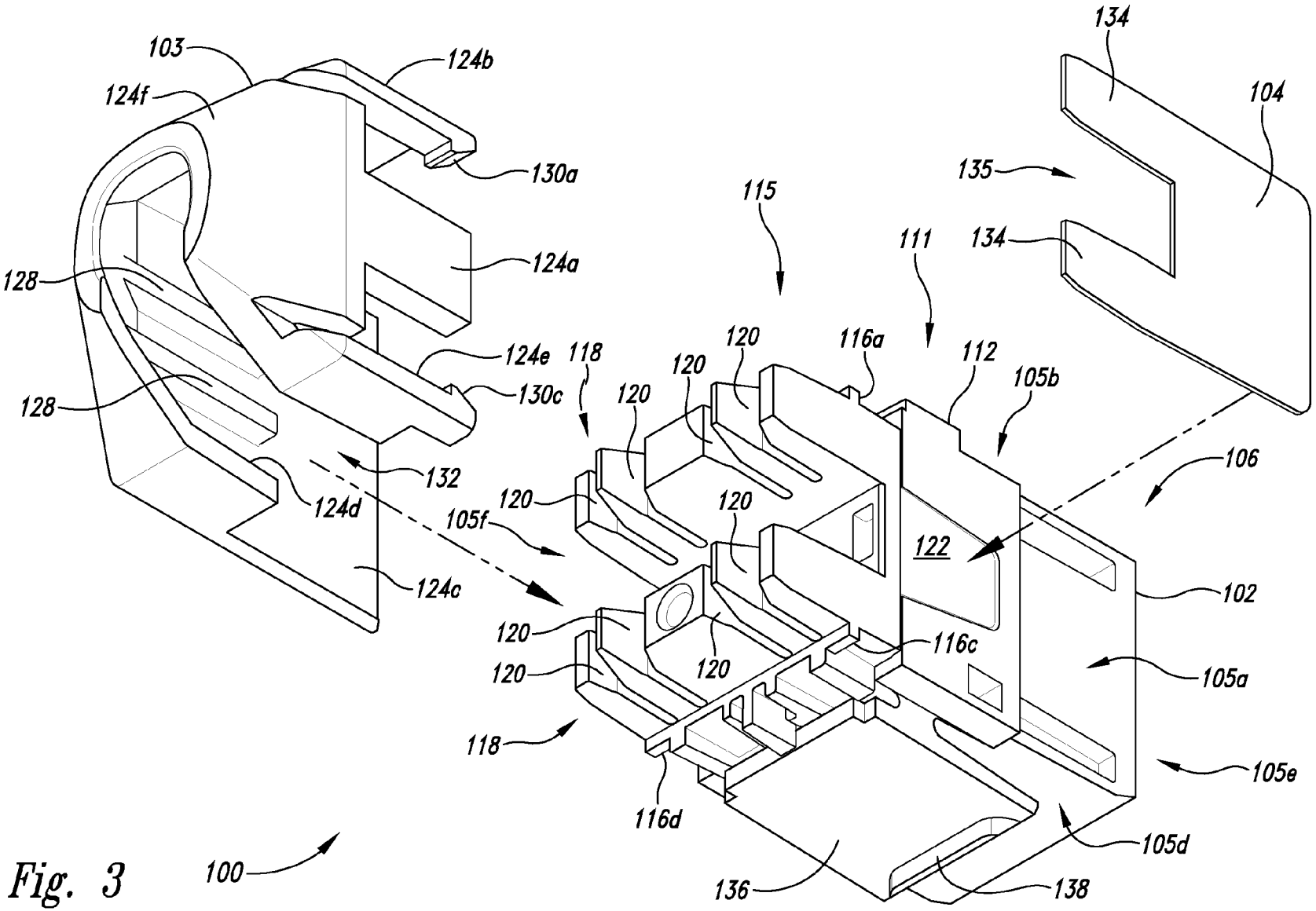
FIG. 3 is an exploded rear perspective view of the shielded connector system of FIG. 1.
Figure 4:
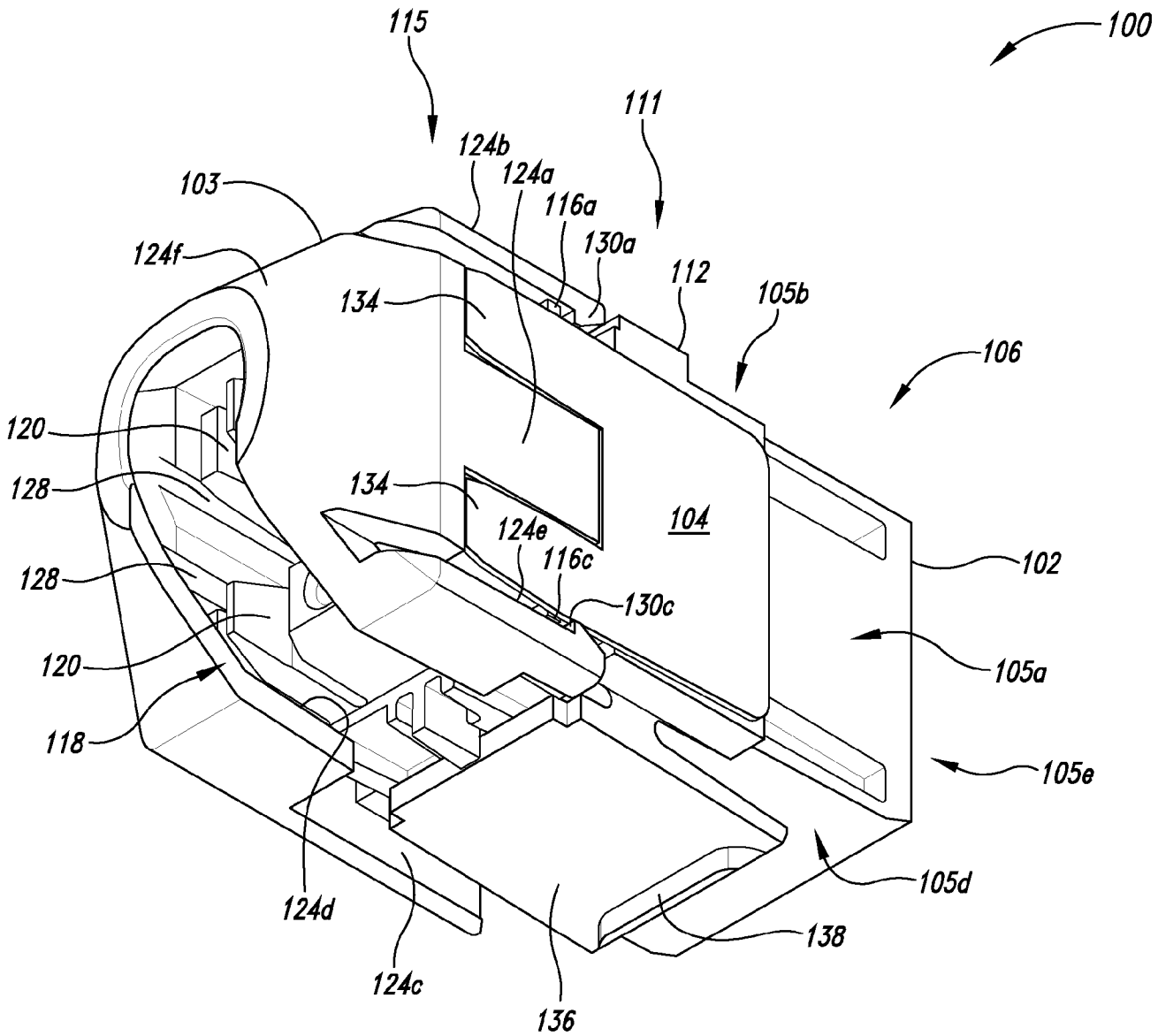
FIG. 4 is a rear perspective view of the shielded connector system of FIG. 1.

As shown in FIG. 3 and FIG. 4, a hinged member 136 extends from the fourth face 105*d* of the connector 102. The hinged member 136 includes a beveled tab 138 for engagement with a port such as of a station 140 shown in FIG. 5. The station 140 includes a mounting frame 142 having ports 144 into which the connectors 102 are inserted. The connectors 102 are each inserted with its own shield enclosure 103 and its own shield sheet 104. The connectors 102 are arranged in the station 140 such that for each pair of adjacent connectors, the shield sheet 104 and the first wall 124*a* of the shield enclosure 103 of the first connector of the pair and the third wall 124*c* of the shield enclosure of the second connector of the pair are positioned between the adjacent connectors.

Consequently, between each of the adjacent pairs of the connectors 102, one of the third walls 124*c* is position therebetween to perform a substantial amount of shielding of crosstalk and noise that could otherwise occur between the adjacent connectors of the pair. The respective shield sheet 104 and the respective first wall 124*a* positioned between the pair adjacent connectors also contribute in reducing crosstalk and noise being transferred between adjacent connectors. The overall combined effect in reducing crosstalk and noise from being transferred between adjacent pairs of the connectors 102 can thus be sizeable.

A second implementation 150 of the shielded connector system is shown in FIGS. 6-9 as having the connector 102 and a shielded enclosure 152. Implementations of the shielded enclosed 152 can be made by a stamping process such as stamping of sheet metal.

The shielded enclosure has a first wall 154*a*, a second wall 154*b*, a third wall 154*c*, a first portion of a fourth wall 154*d*, a second portion of a fourth wall 154*e*, and a rear wall 154*f*. Extending from the second wall 154*b* is a first catch 156*a* and a second catch 156*b*. Extending from the second portion of the fourth wall 154*e* is a third catch 156*c* and extending from the first portion of the fourth wall 154*d* is a fourth catch 156*d*.

Figure 7:
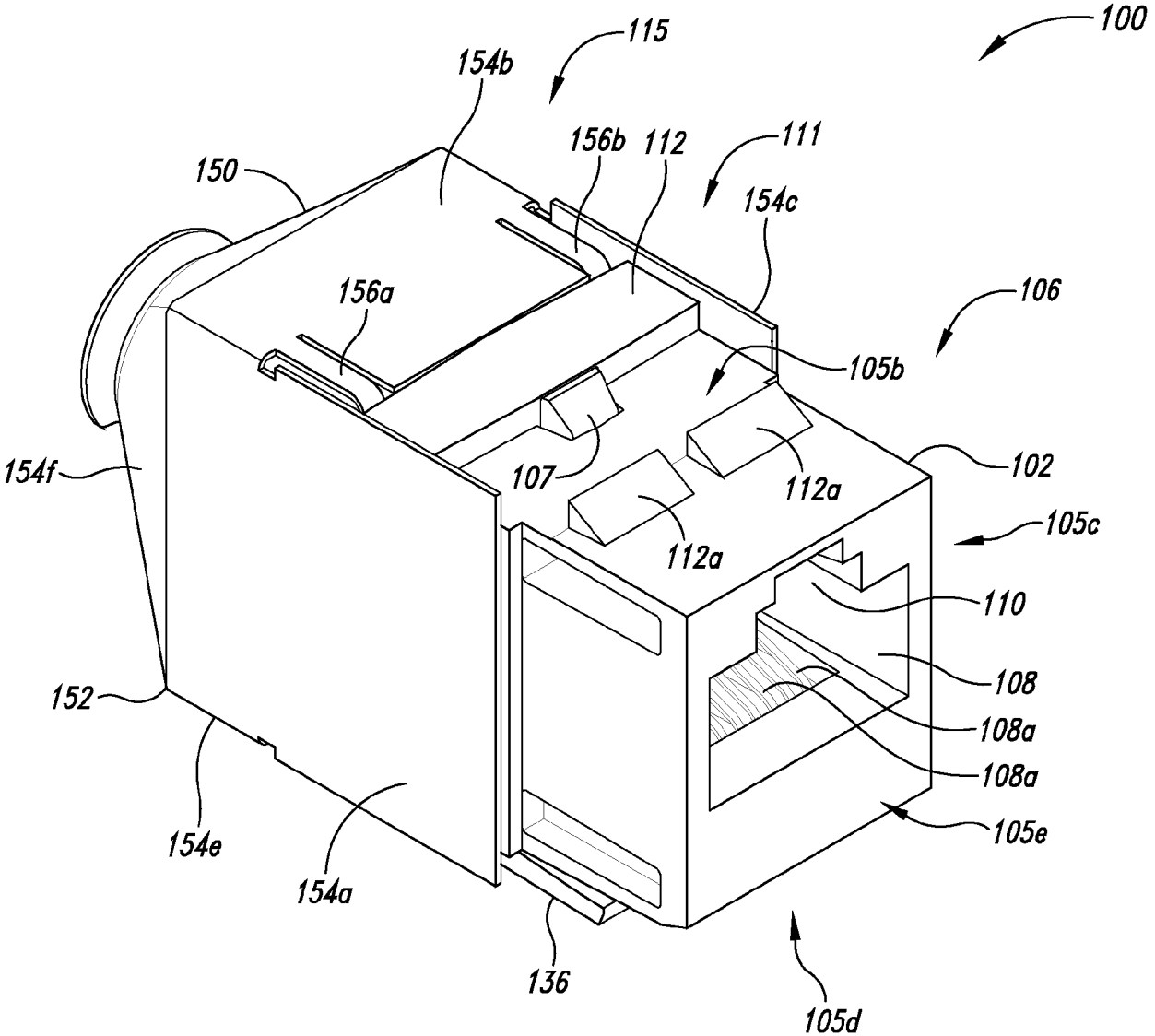
FIG. 7 is a front perspective view of the second implementation of the shielded connector system of FIG. 6.
Figure 8:
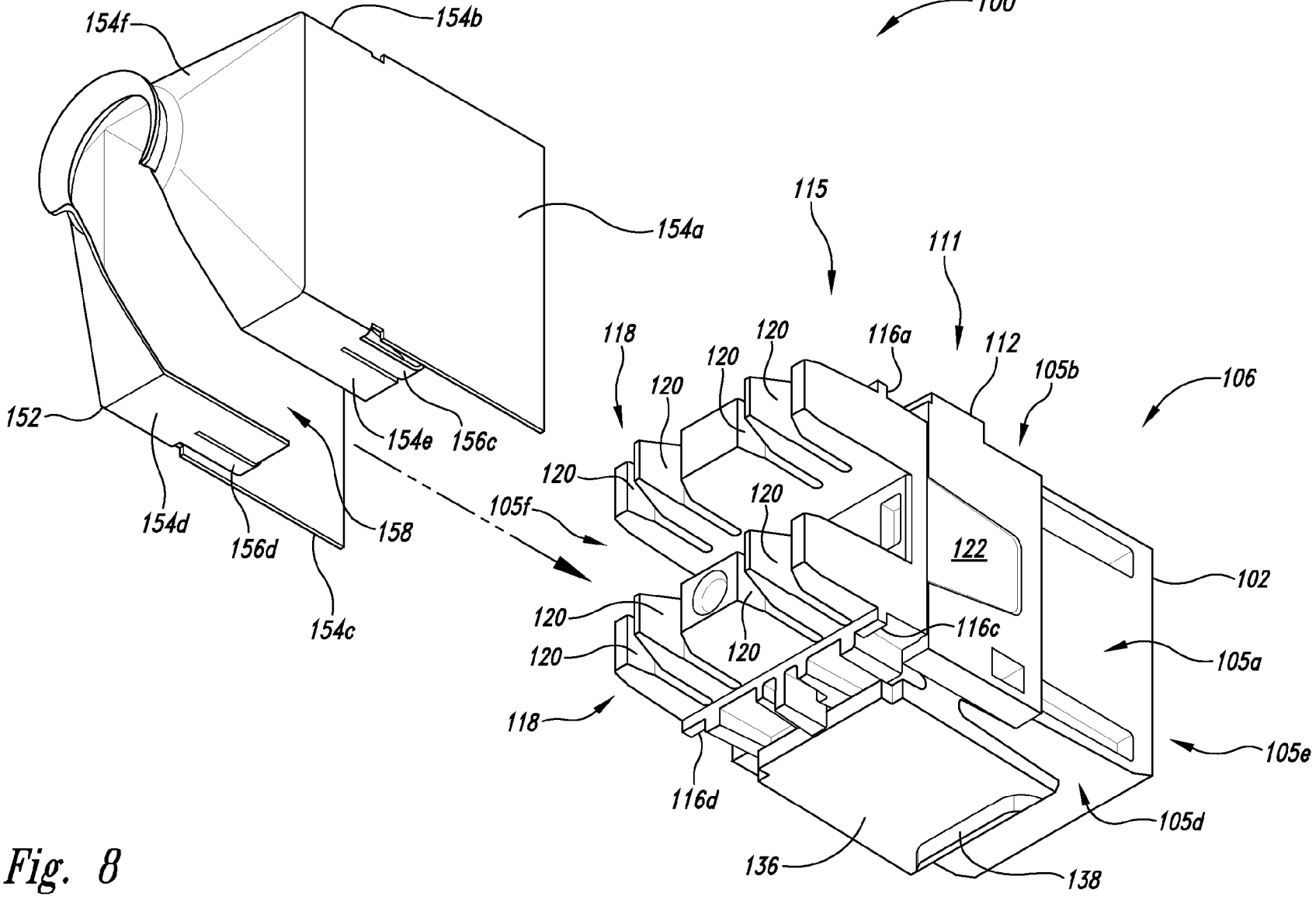
FIG. 8 is an exploded rear perspective view of the shielded connector system of FIG. 6.
Figure 9:
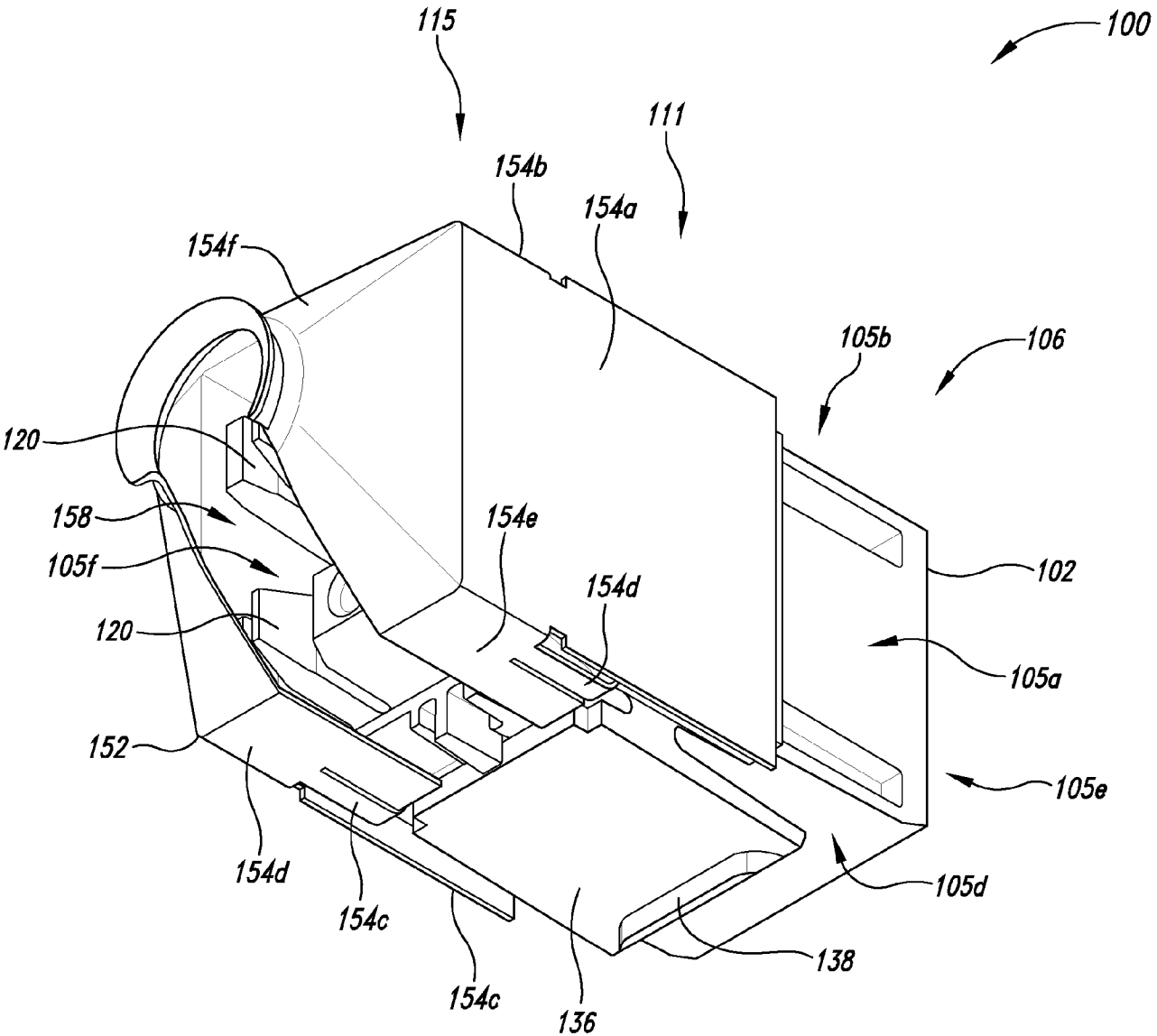
FIG. 9 is a rear perspective view of the shielded connector system of FIG. 6.
Figure 10:
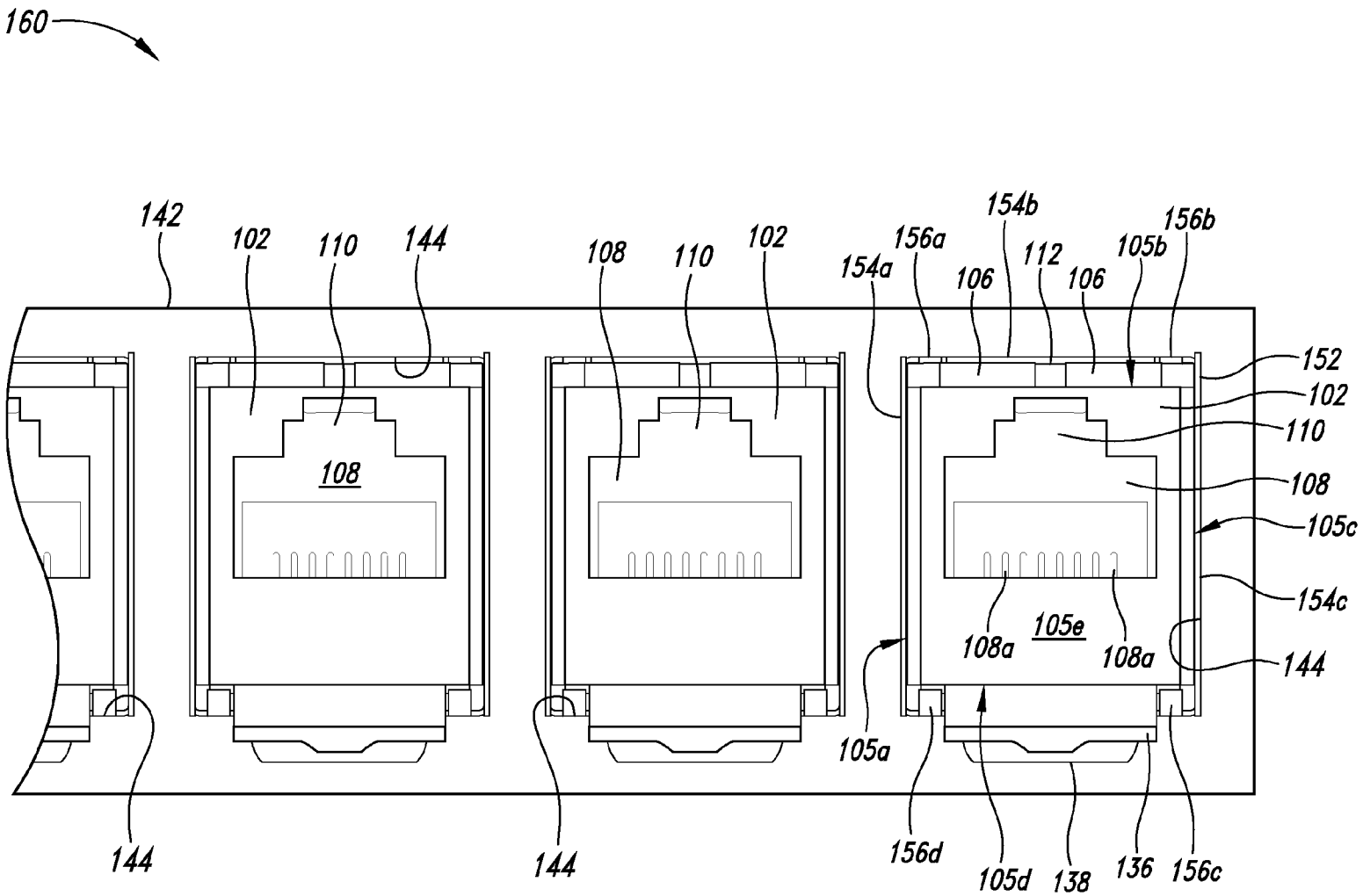
FIG. 10 is a front elevational view of a communication station containing the shielded connector system of FIG. 6.

When the shielded enclosure 152 is engaged with the connector 102, as shown in FIG. 7, the first catch 156*a* of the shielded enclosure engages with the first tab 116*a* of the connector, the second catch 156*b* of the shielded enclosure engages with the second tab 116*b* of the connector, the third catch 156*c* of the shielded enclosure engages with the third tab 116*c* of the connector, and the fourth catch 156*d* of the shield enclosure engages with the fourth tab 116*d* of the connector (better shown in FIG. 8 and FIG. 9). The first portion of the fourth wall 154*d* and the second portion of fourth wall 154*e* are spaced apart to form a slot 158 therebetween to allow for access to the wire pair receivers 118 when the shielded enclosure 152 is engage with the connector 102 as shown in FIG. 9. As shown in FIG. 10, a station 160 includes the mounting frame 142 with the ports 144 each receiving one of the connectors 102 and an associated one of the shielded enclosures 152.

Figure 11:
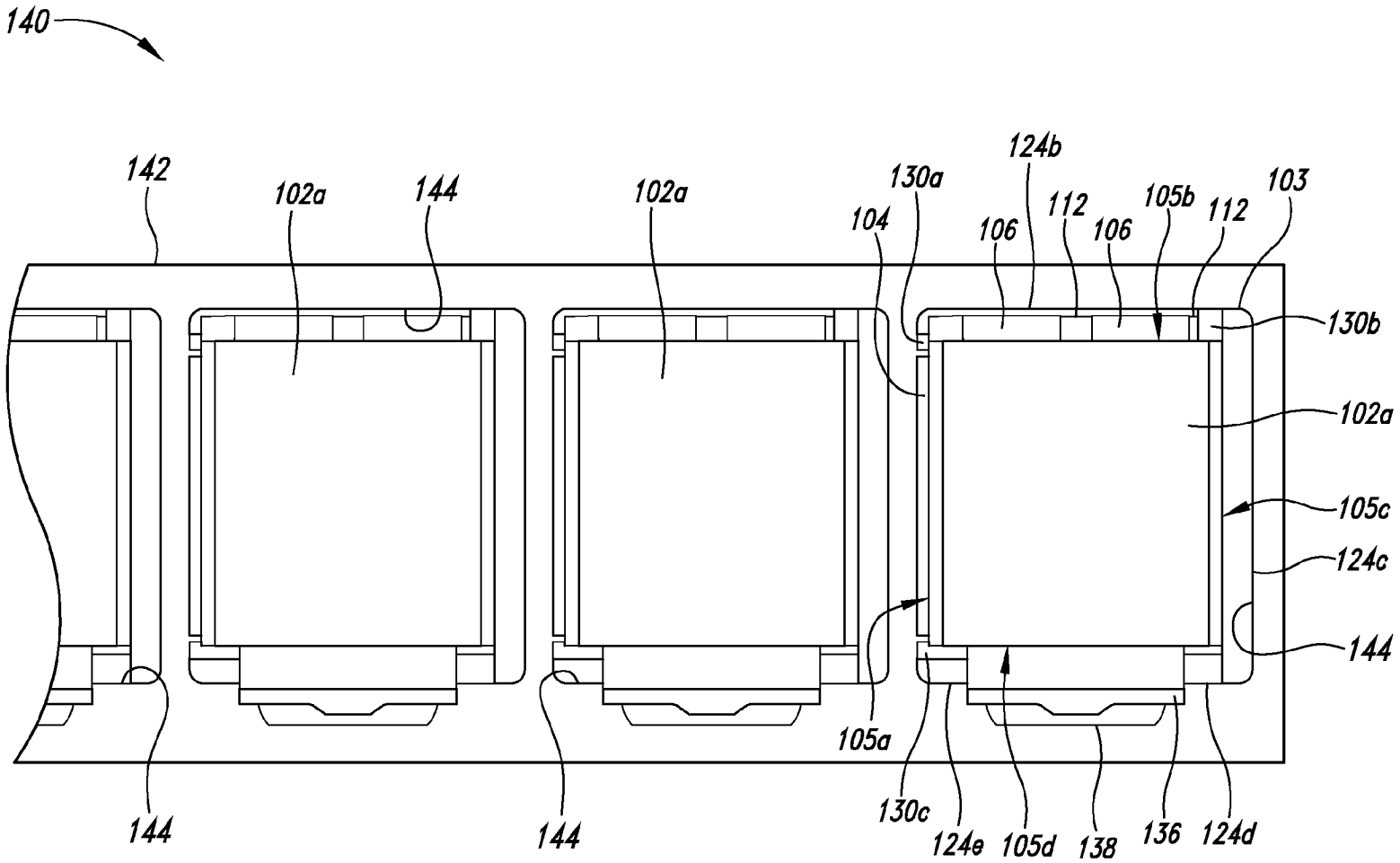
FIG. 11 is a front elevational view of a communication station containing the shielded connector system of FIG. 1 for other implementations of connectors.
Figure 12:
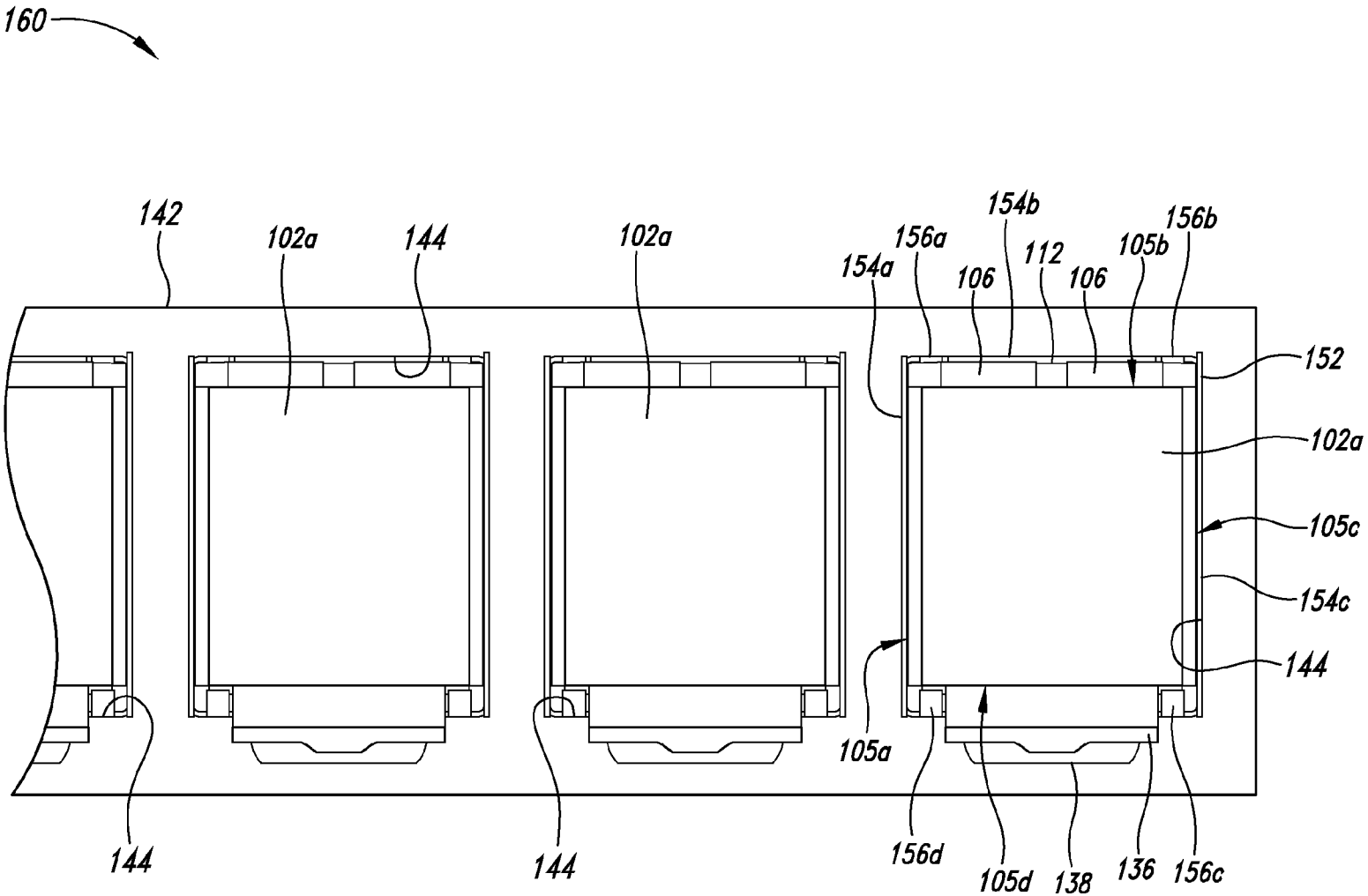
FIG. 12 is a front elevational view of a communication station containing the shielded connector system of FIG. 6 for other implementations of connectors.

Although, the connector 102 was depicted in FIGS. 1-10 as a standard conventional RJ-11 connector, other types of connectors 102*a* could be used with various other implementations of the shield enclosure 103, shown in FIG. 11, and the shield enclosure 152, shown in FIG. 12. These other types of connectors 102*a* can include such standard conventional types of connectors as RJ-45, S-Video, 10G, Cat 6, Cat 6+, RCA, or other standard conventional types of connectors. The connectors 102 and the connectors 102*a* can include such style as conventional QuickPort and Keystone snap-in type connectors.

From the foregoing it will be appreciated that, although specific embodiments of the invention have been described herein for purposes of illustration, various modifications may be made without deviating from the spirit and scope of the invention. For instance, a shield enclosure implementation could be molded with a conductive plastic interior and a resistive outer skin. Other shield enclosure implementations could include stainless steel fiber filled polycarbonate and/or nylon. Some shield enclosure implementations could use a 10% composition of stainless steel. Still other shield enclosure implementations could include polyphenyline sulfide or other material filled with carbon fiber (such as at a 40% composition level). Other shield enclosure implementations could use materials including aluminum flake filled plastics or nickel coated graphite fiber filled plastics.

As depicted in FIG. 2 and FIG. 4, the first wall 124*a* and the shield sheet 104 of the shield enclosure 103 combine to extend from the rear face 105*f* substantially along the first face 105*a* of the rear section 115 and the mid-section 111 up to the front section 106 of the connector 102. The third wall 124*c* of the shield enclosure 103 extends from the rear face 105*f* substantially along the third face 105*c* of the rear section 115 and the mid-section 111 up to the front section 106 of the connector 102. In other implementations, the combination of the shield sheet 104 and the first wall 124*a* and/or the third wall 124*c* of the shield enclosure 103 may extend to a different degree as that depicted. For instance, they may extend along the rear section 115 up to the mid-section 111 or partial along the mid-section, but not entirely up to the front section 106. Alternatively, they may extend further to cover a portion of the first face 105*a* and the third face 105*c*, respectively, of the front section 106 of the connector 102, however, clearances between the front section and port walls (not shown) may prohibit this to a certain degree. Furthermore, the connector 102 could have only the rear section 115 and the front section 106 without the mid-section 111 so that the combination of the shield sheet 104 and the first wall 124*a* and/or the third wall 124*c* of the shield enclosure 103 could be sized differently to provide further coverage of the rear section 115.

As depicted in FIG. 7 and FIG. 9, the first wall 154*a* of the shield enclosure 152 extends from the rear face 105*f* substantially along the first face 105*a* of the rear section 115 and the mid-section 111 up to the front section 106 of the connector 102. The third wall 154*c* of the shield enclosure 152 extends from the rear face 105*f* substantially along the third face 105*c* of the rear section 115 and the mid-section 111 up to the front section 106 of the connector 102. In other implementations, the first wall 154*a* and/or the third wall 154*c* of the shield enclosure 152 may extend to a different degree as that depicted. For instance, they may extend along the rear section 115 up to the mid-section 111 or partial along the mid-section, but not entirely up to the front section 106. Alternatively, they may extend further to cover a portion of the first face 105*a* and the third face 105*c*, respectively, of the front section 106 of the connector 102, however, clearances between the front section and port walls may prohibit this to a certain degree. Furthermore, the connector 102 could have only the rear section 115 and the front section 106 without the mid-section 111 so that the first wall 154*a* and/or the third wall 154*c* of the shield enclosure 152 could be sized differently to provide further coverage of the rear section 115.

As depicted the second wall 124*b*, the first portion of the fourth wall 124*d*, and the second portion of the fourth wall 124*e* of the shield enclosure 103 extend forwardly from the rear face 105*f* a majority of the rear section 115 of the connector 102. The second wall 154*b*, the first portion of the fourth wall 124*d*, and the second portion of the fourth wall 124*e* of the shield enclosure 152 extended substantially forwardly from the rear face 105*f* a majority of the rear section 115 of the connector 102. In other implementations, the degree to which these various walls extend could also differ to cover amounts of the rear section 115 different than depicted. In other implementations, the connector 102 could have only the rear section 115 and the front section 106 without the mid-section 111 so that these various walls could be sized differently to provide further coverage of the rear section 115.

As further examples, other shielded enclosure implementations use various materials including but not limited to cartridge brass, phosphor bronze, stainless steel, nickel silver, and nickel bronze in sheet metal. Other shielded enclosure implementations can use injection molded parts with associated resin being impregnated with conductive material. In some shielded enclosure implementations using stamped metal, an insulator can be placed on the inside of the stamped metal to prevent accidental contact of associated terminated wires. However in other shielded enclosure implementations, stamped metal can be located sufficiently far from terminated wires so that such an insulator may not be necessary. Accordingly, the invention is not limited except as by the appended claims.

The invention claimed is:

1. A system for a connector, the connector having a front face and a rear face with a first face, a second face, a third face and a fourth face extending therebetween, the first face being substantially perpendicular to the second face and the fourth face and extending therebetween, the third face being substantially perpendicular to the second face and the fourth face and extending therebetween, the connector having a front section with the front face and a rear section with the rear face, the front section having a plug receiving portion along the front face to receive a communication plug, the plug receiving portion having a plug engagement notch substantially adjacent a portion of the second face, the rear section having wire receivers each with a wire slot to receive a wire, the system comprising:

a shield enclosure having a right wall, the right wall configured to couple to the connector, when coupled to the connector, the right wall sized to substantially cover a portion of the third face of the connector extending forwardly from the rear face of the connector toward the front face of the connector along substantially the entire rear section of the connector, the right wall configured to substantially reduce crosstalk from passing through the right wall;

a rear wall extending from the right wall, the rear wall sized and positioned to cover a portion of the rear face of the connector along a portion of the rear section when the shield enclosure is coupled to the connector, the rear wall configured to substantially reduce crosstalk from passing through the rear wall;

a left wall extending from the rear wall, the left wall sized to partially cover a portion of the first face of the connector extending forwardly from the rear face of the connector toward the front face of the connector partially along the rear section of the connector, the top wall configured to substantially reduce crosstalk from passing through the left wall; and a shield sheet sized to cover some portions of the first face of the connector not covered by the left wall when the shield sheet and the left wall are engaged with the connector, the shield sheet being a distinctly separate member from the left wall, the shield sheet configured to substantially reduce crosstalk from passing through the shield sheet.

2. The system of claim 1 wherein the shield sheet has a first extended portion and a second extended portion spaced therefrom to form a slot, the slot sized and rearwardly facing to be in juxtaposition with the left wall when the left wall and the shield sheet are engaged with the connector.

3. The system of claim 1 wherein the shield sheet is made from foil.

4. A system for a connector, the connector having a front face and a rear face with a first face, a second face, a third face and a fourth face extending therebetween, the first face being substantially perpendicular to the second face and the fourth face and extending therebetween, the third face being substantially perpendicular to the second face and the fourth face and extending therebetween, the connector having a front section with the front face and a rear section with the rear face, the front section having a plug receiving portion along the front face to receive a communication plug, the plug receiving portion having a plug engagement notch substantially adjacent a portion of the second face, the rear section having wire receivers each with a wire slot to receive a wire, the system comprising:

a shield enclosure having a right wall, the third wall configured to couple to the connector, when coupled to the connector, the right wall sized to substantially cover a portion of the third face of the connector extending forwardly from the rear face of the connector toward the front face of the connector along substantially the entire rear section of the connector, the right wall configured to substantially reduce crosstalk from passing through the right wall;

a rear wall extending from the right wall, the rear wall sized and positioned to cover a portion of the rear face of the connector along a portion of the rear section when the shield enclosure is coupled to the connector, the rear wall configured to substantially reduce crosstalk from passing through the rear wall;

a left wall extending from the rear wall, the left wall sized to partially cover a portion of the first face of the connector extending forwardly from the rear face of the connector toward the front face of the connector partially along the rear section of the connector, the left wall configured to substantially reduce crosstalk from passing through the left wall; and a bottom wall extending from the rear wall, the bottom wall sized to partially cover a portion of the fourth face of the connector extending forwardly from the rear face of the connector toward the front face of the connector partially along the rear section of the connector, the bottom wall configured to substantially reduce crosstalk from passing through the bottom wall, the bottom wall having a first portion and a second portion spaced apart therefrom to form a slot, the slot extending partially into the rear wall to allow for at least one of the following: access to the wire receivers of the connector and capability to engage the shield enclosure with the connector while one or more wires are engaged with the wire receivers of the connector.

5. A system for a connector, the connector having a front face and a rear face with a first face, a second face, a third face and a fourth face extending therebetween, the first face being substantially perpendicular to the second face and the fourth face and extending therebetween, the third face being substantially perpendicular to the second face and the fourth face and extending therebetween, the connector having a front section with the front face and a rear section with the rear face, the front section having a plug receiving portion along the front face to receive a communication plug, the plug receiving portion having a plug engagement notch substantially adjacent a portion of the second face, the rear section having wire receivers each with a wire slot to receive a wire, the system comprising:

a shield enclosure having a right wall, the right wall configured to couple to the connector, when coupled to the connector, the right wall sized to substantially cover a portion of the third face of the connector extending forwardly from the rear face of the connector toward the front face of the connector along substantially the entire rear section of the connector, the right wall configured to substantially reduce crosstalk from passing through the right wall;

a rear wall extending from the right wall, the rear wall sized and positioned to cover a portion of the rear face of the connector along a portion of the rear section when the shield enclosure is coupled to the connector, the rear wall configured to substantially reduce crosstalk from passing through the rear wall;

a left wall extending from the rear wall, the left wall sized to substantially cover a portion of the first face of the connector extending forwardly from the rear face of the connector toward the front face of the connector partially along the rear section of the connector substantially up to the front section, the left wall configured to substantially reduce crosstalk from passing through the left wall;

a top wall extending from the rear wall, the top wall sized to partially cover a portion of the second face of the connector extending forwardly from the rear face of the connector toward the front face of the connector partially along the rear section of the connector, the top wall configured to substantially reduce crosstalk from passing through the right wall; and a bottom wall extending from the rear wall, the bottom wall sized to partially cover a portion of the fourth face of the connector extending forwardly from the rear face of the connector toward the front face of the connector partially along the rear section of the connector, the bottom wall configured to substantially reduce crosstalk from passing through the bottom wall, the bottom wall having a first portion and a second portion spaced apart therefrom to form a slot, the slot extending partially into the rear wall to allow for at least one of the following: access to the wire receivers of the connector and capability to engage the shield enclosure with the connector while one or more wires are engaged with the wire receivers of the connector.

* * * * *

UNITED STATES PATENT AND TRADEMARK OFFICE

CERTIFICATE OF CORRECTION

PATENT NO. : 7,273,396 B2
APPLICATION NO. : 11/424219
DATED : September 25, 2007
INVENTOR(S) : Michael Itano et al.

It is certified that error appears in the above-identified patent and that said Letters Patent is hereby corrected as shown below:

Claim 5, column 8, line 32, “third wall; and” should read --top wall; and--.

Signed and Sealed this

Seventh Day of October, 2008

JON W. DUDAS
*Director of the United States Patent and Trademark Office*